US011885208B2

(12) United States Patent
Kohli et al.

(10) Patent No.: US 11,885,208 B2
(45) Date of Patent: Jan. 30, 2024

(54) AUTOMATED PRECISE CONSTANT PRESSURE FRACTURING WITH ELECTRIC PUMPS

(71) Applicant: Halliburton Energy Services, Inc., Houston, TX (US)

(72) Inventors: Madhur Kohli, Houston, TX (US); Alexander Simon Chretien, Houston, TX (US); Vladimir Nikolayevich Martysevich, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/855,984

(22) Filed: Jul. 1, 2022

(65) Prior Publication Data

US 2024/0003236 A1 Jan. 4, 2024

(51) Int. Cl.

| | |
|---|---|
| ***E21B 43/26*** | (2006.01) |
| ***E21B 43/267*** | (2006.01) |
| ***F04B 17/06*** | (2006.01) |
| ***F04B 17/03*** | (2006.01) |

(52) U.S. Cl.

CPC ..... *E21B 43/2607* (2020.05); *E21B 43/267* (2013.01); *F04B 17/03* (2013.01); *F04B 17/06* (2013.01); *E21B 2200/20* (2020.05)

(58) Field of Classification Search

CPC ..... E21B 43/26; E21B 43/2607

See application file for complete search history.

(56) References Cited

U.S. PATENT DOCUMENTS

| | | | | |
|---|---|---|---|---|
| 8,834,012 | B2 | 9/2014 | Case et al. | |
| 9,297,250 | B2 | 3/2016 | Dusterhoft et al. | |
| 9,650,871 | B2 * | 5/2017 | Oehring | F04B 51/00 |
| 9,970,278 | B2 * | 5/2018 | Broussard | E21B 43/2607 |
| 10,246,984 | B2 * | 4/2019 | Payne | E21B 44/00 |
| 10,871,045 | B2 * | 12/2020 | Fischer | F04D 13/0693 |
| 11,028,677 | B1 * | 6/2021 | Yeung | E21B 43/267 |
| 11,415,125 | B2 * | 8/2022 | Yeung | F04B 49/065 |
| 11,473,413 | B2 * | 10/2022 | Yeung | F04B 49/022 |
| 2020/0232454 | A1 | 7/2020 | Chretien et al. | |
| 2020/0300050 | A1 * | 9/2020 | Oehring | E21B 21/08 |
| 2020/0355055 | A1 | 11/2020 | Dusterhoft et al. | |

* cited by examiner

*Primary Examiner* — Kenneth L Thompson

(74) *Attorney, Agent, or Firm* — Conley Rose, P.C.; Rodney B. Carroll

(57) ABSTRACT

A method of controlling a pumping stage of a fracturing fleet at a wellsite with a set of electric frac pumps to deliver fracturing fluids into a target formation at a steady pressure value. An global control process on a computer system communicatively connected to the plurality of pumping units can communicate a unit setpoint to each pumping unit, monitor the sensor measurements, compare the periodic datasets to a target pressure, and modify the fluid output of the pump units to achieve the target pressure during the pumping operation. The global control process can direct at least one pumping unit to deliver a fracturing treatment at a pressure higher or lower than the target pressure in response to changing wellbore environment pressures.

21 Claims, 5 Drawing Sheets

AUTOMATED PRECISE CONSTANT PRESSURE FRACTURING WITH ELECTRIC PUMPS

BACKGROUND

Subterranean hydraulic fracturing is conducted to increase or "stimulate" production from a hydrocarbon well. To conduct a fracturing process, high pressure is used to pump special fracturing fluids, including some that contain propping agents ("proppants") down-hole and into a hydrocarbon formation to split or "fracture" the rock formation along veins or planes extending from the well-bore. Once the desired fracture is formed, the fluid flow is reversed and the liquid portion of the fracturing fluid is removed. The proppants are intentionally left behind to stop the fracture from closing onto itself due to the weight and stresses within the formation. The proppants thus literally prop-apart or support the fracture to stay open, yet remain highly permeable to hydrocarbon fluid flow since they form a packed bed of particles with interstitial void space connectivity. Sand is one example of a commonly-used proppant. The newly-created-and-propped fracture or fractures can thus serve as new formation drainage area and new flow conduits from the formation to the well, providing for an increased fluid flow rate, and hence increased production of hydrocarbons.

The high pressure applied at surface during the hydraulic fracturing process can fluctuate due to changes in the hydrocarbon formation. A need exists to control the applied high pressure in response to downhole pressure fluctuations to provide a constant applied high pressure during the hydraulic fracturing process.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
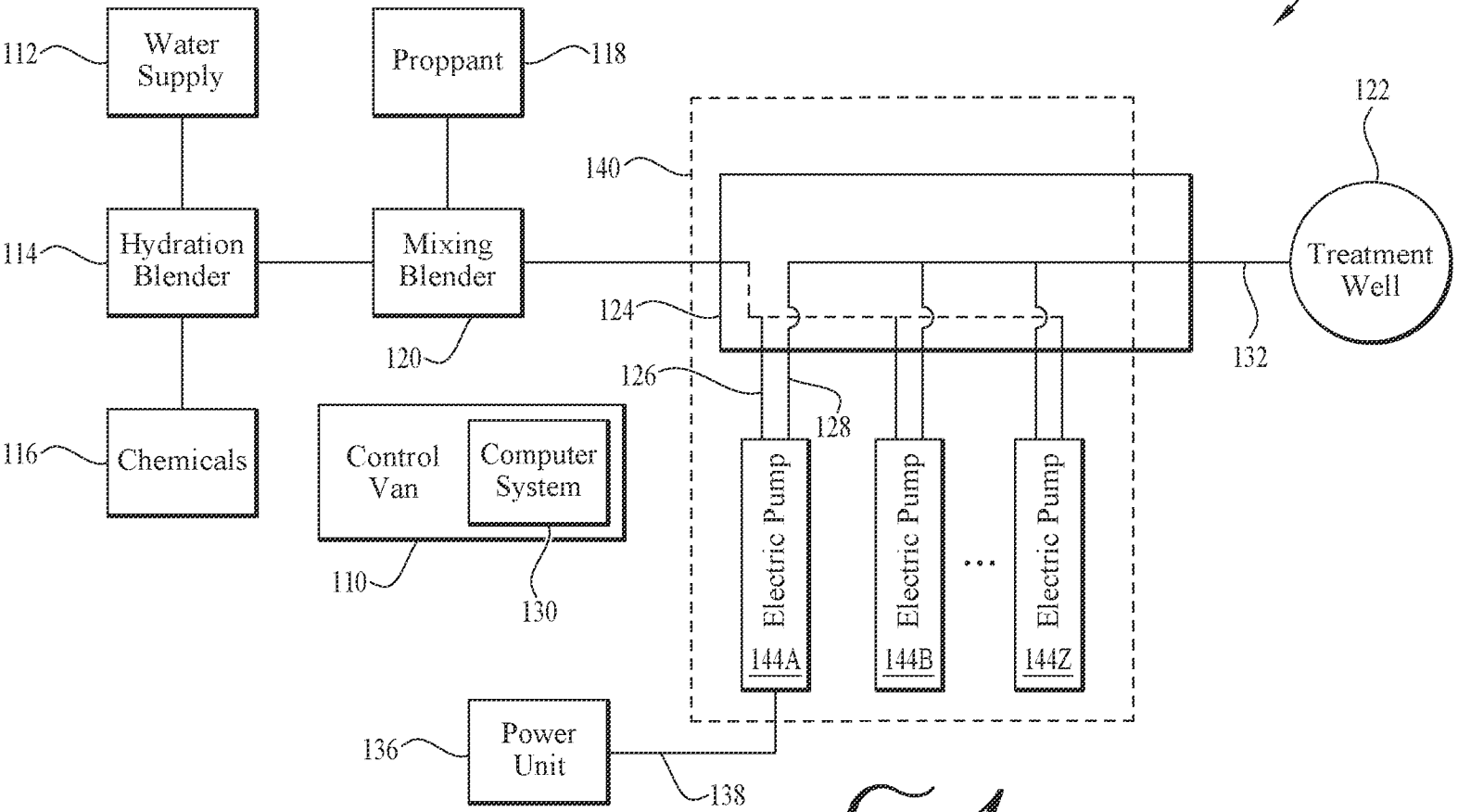
FIG. 1 is a block diagram of a hydraulic fracturing system connected to a treatment well according to an embodiment of the disclosure.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

A modern fracturing fleet typically includes a water supply, a proppant supply, one or more blenders, a plurality of pump units, and a fracturing manifold connected to the wellhead. The individual units of the fracturing fleet can be connected to a central control unit called a data van. The control unit can control the individual units of the fracturing fleet to provide proppant slurry at a desired pressured and flowrate to the wellhead. The control unit can manage the pump speeds, chemical intake, and proppant density while pumping fracturing fluids and receiving data relating to the pumping operation from the individual units.

A modern fracturing fleet can utilize multiple types of pumping equipment to maximize operational use of equipment and personnel. The fracturing fleet can comprise available pumping equipment, e.g., pump units, of various pumping capabilities and powered by diesel motors, electric motors, or hydraulic motors. The term pump unit can refer to pumping equipment with a power end and a motor section coupled to a fluid end that is configured to pump a treatment fluid into a wellbore. An electric frac pump can be a pump unit with an electric motor coupled to a fluid end of a pump. A diesel frac pump can be a pump unit with a diesel motor and transmission coupled to a fluid end of a pump. The diesel frac pump can have a different power input (e.g., horsepower) and reaction time than an electric frac pump. The output, e.g., the pressure and flow rate of the treating fluid, of the plurality of pump units can vary depending on the type (diesel frac pump or electric frac pump), the capacity, the power input, the service history, or combinations thereof.

The downhole environment at the target formation can experience unexpected changes during the hydraulic fracturing operation. In one scenario, the pumping operation can encounter wellbore pressures that are lower than expected resulting in a drop or decrease in the pumping pressure. For example, the fracturing operation may open a fracture that connects the target formation with a second formation or the target formation may be a larger volume than expected. In another scenario, the pumping operation can encounter wellbore pressures that are higher than expected resulting in an increase in the pumping pressure. For example, the target formation may be connected to an adjacent well that has been previously fractured or the target formation may be a smaller volume than expected. The pressure response of the target formation can change faster than an equipment operator can react to resulting in the formation fracturing in a detrimental manner. For example, over-pressure of the target formation, e.g., applying pressure over the target pressure value, can cause too many or widened fractures near the wellbore. In another scenario, under-pressuring the target formation, e.g., applying pressure under the target pressure value, can result in small or sparse number of fractures. Both under-pressuring and over-pressuring the target formation can decrease the fracturing performance resulting in a reduce rate or reduced volume of hydrocarbon production from the target formation. A method of controlling the hydraulic fracturing pressure to provide a constant target pressure value is needed. One solution to applying a constant target pressure value while pumping a hydraulic fracturing treatment into a target formation can comprise a global control process executing on a computer system within a control van communicatively connected to the fracturing fleet. The global control process can direct the pumping operation of the plurality of electric frac pumps while delivering a fracturing fluid into the target formation at a target pressure value. In some embodiments, the global control process can maintain the target pressure value during the pumping operation by modifying the operating setpoint, e.g., the pressure and flowrate, of at least one of the plurality of pumping units. For example, the global control process can increase the flowrate of one of the plurality of pumping units to maintain the target pressure value applied to a wellbore. In another scenario, the global control process can decrease the flowrate of one of the plurality of pumping units to maintain the target pressure value applied to a wellbore. In some embodiments, the global control process can modify a portion, e.g., at least two, simultaneously or sequentially of the plurality of pump units to maintain the target pressure value. For example, the global control process can reduce the flowrate to a second pump unit, then a third pump unit, and so forth to maintain the target pressure. The global control process can maintain an optimum pressure, e.g., the target pressure value, for each setpoint of the pumping operation.

The method of controlling the hydraulic fracturing pressure to provide a constant target pressure value can also provide unit level control for each electric frac pump. One solution to applying a constant target pressure value while pumping a hydraulic fracturing treatment into a target formation can comprise a unit control process executing on a unit controller within each electric frac unit of the fracturing fleet. The unit control process can direct the pumping operation of the electric frac pump while delivering a fracturing fluid to a manifold, also referred to as a missile. In some embodiments, the unit control process can maintain the target pressure value during the pumping operation by modifying a control setpoint, e.g., the pressure and flowrate, received from the pumping procedure. For example, the unit control process can increase the pressure output of the fluid end to maintain a target pressure applied to the manifold or to a wellbore. In another scenario, the unit control process can decrease the pressure output of the fluid end to maintain a target pressure applied to the man fold or to a wellbore. The unit control process can maintain an optimum target pressure for each setpoint of the pumping operation based on sensor data from the wellhead and/or sensor data from the pumping unit.

Disclosed herein is a method of controlling the hydraulic fracturing pressure to maintain a constant target pressure value while pumping a hydraulic fracturing treatment into a target formation with a global control process communicatively connected to the fracturing fleet. The global control process can direct the pumping operation of the plurality of electric frac pumps to deliver a fracturing fluid at a constant pressure into the target formation by modifying the operating setpoint of at least one of the plurality of electric frac pumps. A method of controlling the hydraulic fracturing pressure can comprise a unit control process on a unit controller of each of the electric frac pumps. The unit control process can maintain the target fracturing pressure value by modifying a control setpoint received from the global control process.

Described herein is a typical fracturing fleet at a wellsite fluidically connected to a wellbore. The fracturing fleet can comprise a mixture of electric-powered pump units that can be partially controlled or fully controlled by a process on a computer system with feedback of equipment data provided by sensors on the fracturing fleet indicative of a pumping operation. Turning now to FIG. 1, an embodiment of a hydraulic fracturing fleet 100 that can be utilized to pump wellbore treatment fluids into a wellbore, is illustrated. The fracturing fleet, also referred to as a fracturing spread, comprises a chemical unit 116, a hydration blender 114, a water supply unit 112, a mixing blender 120, a proppant storage unit 118, a manifold 124 and a plurality of pump units 140 fluidically connected to a treatment well 122. The treatment well 122 may include a wellhead connector, a production tree, a wellhead, and a wellbore drilled into a porous subterranean formation containing formation fluids. As depicted, the plurality of pump units 140 (also referred to as hydraulic fracturing pumps, "frac pumps", or high horsepower pumps) are connected in parallel to the manifold 124 (also referred to as a "missile" or a fracturing manifold) to provide wellbore treatment fluids, e.g., fracturing fluids, to the treatment well 122. The fracturing fluids are typically a blend of friction reducer and water, e.g., slick water, and proppant. In some cases, a gelled fluid (e.g., water, a gelling agent, optionally a friction reducer, and/or other additives) may be created in the hydration blender 114 from the water supply unit 112 and gelling chemicals from the chemical unit 116. When sack water is used, the hydration blender 114 can be omitted. The proppant concentration of the fluid delivered to the manifold (e.g., manifold 124) can be provided by a mixing blender (e.g., mixing blender 120) by adding proppant at a controlled rate from the proppant storage unit 118 to the gelled fluid in the mixing blender 120. The mixing blender 120 is in fluid communication with the manifold 124 so that the fracturing treatment is pumped into the manifold 124 for distribution to the pump units 140, via supply line 126. The fracturing fluids are returned to the manifold 124 from the pump units 140, via high-pressure line 128, to be pumped into the treatment well 122 that is in fluid communication with the manifold 124 via the high-pressure line 132. The wellhead connector can releasably connect the high-pressure line 132 to the production tree or similar high-pressure isolation device connected to the wellhead. Although fracturing fluids typically contain a proppant, a portion of the pumping sequence may include a fracturing fluid without proppant (sometimes referred to as a pad fluid). Although fracturing fluids typically include a gelled fluid, the fracturing fluid may be blended without a gelling chemical. Alternatively, the fracturing fluids can be blended with an acid to produce an acid fracturing fluid, for example, pumped as part of a spearhead or acid stage that clears debris that may be present in the wellbore and/or fractures to help clear the way for fracturing fluid to access the fractures and surrounding formation. The sensors on the fracturing fleet can measure the equipment operating conditions including temperature pressure, flow rate, density, viscosity, chemical, vibration, rotation, rotary position, strain, accelerometers, exhaust, acoustic, fluid level, and equipment identity.

Each of the pump units 140 comprises a pump power end and a pump fluid end. The pump fluid end of the pump unit 140 includes a pump section with a suction valve, a discharge valve, and fluid sensors. In some embodiments, the pump section is a piston pump with at least one reciprocating piston or plunger that draws treatment fluid into a chamber through the suction valve, pressurizes the fluid within the pump chamber, and discharges the pressurized fluid through the discharge valve. The pump section may include one, two, three, or more pistons or plungers within the pump fluid end. The fluid sensors can measure the fluid pressure at the inlet chamber, the suction valve, the pump chamber, the discharge valve, the discharge chamber, or combinations thereof. In some embodiments, the pump section comprises a single stage centrifugal pump with an impeller (also referred to as a rotor) coupled to a drive shaft and a diffuser coupled to a housing. In some embodiments, the pump section comprises a multiple stage centrifugal pump. In some embodiments, the pump section comprises a centrifugal pump, a progressive cavity pump, an auger pump, a rod pump, a turbine pump, a screw pump, a gear pump, or combinations thereof.

The pump power end of the pump unit 140 provides rotational power for the pump section. In some embodiments, the pump power end comprises a motor with a drive shaft coupled to a flywheel with a crank shaft arm mechanically coupled to the reciprocating piston or plunger. The rotational motion of the flywheel provides the reciprocating motion for the piston or plunger via the crank shaft arm. One or more positional sensors can measure the angular position, rotational position, rotational speed, or combinations thereof of the drive shaft, flywheel, crank shaft arm, or combinations thereof. The positional sensors can include a rotary encoder, a shaft encoder, a rotary potentiometer, a resolver, a rotary variable differential transformer, or combinations thereof. The rotary encoder may be an absolute rotary encoder that measures the current shaft position or an incremental encoder that provides information about the motion of the shaft, e.g., rotational position, speed, and angular distance. In some embodiments, the pump power end comprises a motor with a drive shaft directly coupled to the pump section of the fluid end. For example, the pump power end may be directly coupled to a pump shaft of a centrifugal pump. The pump power end can include an electric motor to provide the rotational power.

In some embodiments, the plurality of pump units 140 includes at least two electric frac pumps 144 comprising a pump power end with an electric motor mechanically coupled to the fluid end to provide rotational motion to the pump section. A variable frequency drive (VFD) may communicatively couple the electric motor to a unit controller on the electric frac pump 144. The VFD can control the torque, speed, and angular position of the drive shaft of the electric motor per directions from the unit controller. For example, the VFD may establish a rotational speed, e.g., revolutions per minute (RPM), of the drive shaft of the electric motor per direction from the unit controller. In some embodiments, the electric motor provides rotational motion for a pump fluid end with a piston pump. In some embodiments, the electric motor provides rotational motion for a pump fluid end with a single stage or multiple stage centrifugal pump. In some embodiments, the electric motor provides rotational motion for a pump fluid end with the pump section comprising a centrifugal pump, a progressive cavity pump, an auger pump, a rod pump, a turbine pump, a screw pump, a gear pump, or combinations thereof.

In some embodiments, a power unit 136 can be coupled to the electric frac pump 144 by an umbilical cable 138 to provide electrical power to the electric frac pump 144 via the VFD. The power unit 136 can be an electrical generator, an electrical battery, an electrical transformer, or combinations thereof. The power unit 136 may include a electrical generator powered by a hydrocarbon fuel engine or turbine, or a wind power turbine. For example, a diesel engine or natural gas turbine. The power unit 136 may generate electricity via a fuel cell. For example, the power unit 136 may generate electricity via a hydrogen fuel cell or natural gas fuel cell via a chemical reaction. The power unit 136 may include solar panels to generate electricity via the sun. The power unit 136 may include an electrical battery to provide stored electrical power. The power unit 136 may be connected to the power grid, e.g., local power lines, to provide electrical power. Although the power unit 136 is illustrated as connected to one electric pump, it is understood that the power unit 136 can provide power to all the electric frac pumps 144A-Z, the control van 110, the mixing blender 120, and the hydration blender 114.

A control van 110 can be communicatively coupled (e.g., via a wired or wireless network) to any of the frac units of the fracturing spread wherein the term "frac units" may refer to any of the plurality of pump units 140, the manifold 124, the mixing blender 120, the proppant storage unit 118, the hydration blender 114, the water supply unit 112, and the chemical unit 116. Each of the frac units can have a unit controller, e.g., a computer system, that establishes control of the equipment, e.g., pumping equipment, and receives data from equipment sensors, e.g., flow rate sensors. A managing process executing on a computer system 130 within the control van 110 can establish unit level control over the frac units communicated via the network. Unit level control can include sending instructions to the unit controller of each frac unit and/or receiving equipment data via the unit controller from the frac units. For example, the managing process on the computer system 130 within the control van 110 can establish a flowrate of 25 bpm with the plurality of pump units 140 while receiving pressure and rate of pump crank revolutions from sensors on the pump units 140. The computer system 130 can also receive data from the wellbore environment from sensors attached to the treatment well 122, located in the treatment well 122 located in one or more observation wells, or combinations thereof. In an example, the computer system 130 may receive data from sensors attached to a production tree of the treatment well 122. In another scenario, the computer system 130 may receive data from downhole sensors, e.g., fiber optic sensors, located within the wellbore of the treatment well 122. The wellhead and downhole sensors can measure the environment inside the treatment well including temperature, pressure, flow rate, density, viscosity, chemical, vibration, strain, accelerometers, and acoustic. In still another scenario, the computer system 130 may receive data from sensors attached to a production tree, located within a wellbore, or combinations thereof on one or more observation wells, e.g., an offset well.

Although the managing process is described as executing on a computer system 130, it is understood that the computer system 130 can be any form of a computer system such as a server, a workstation, a desktop computer, a laptop computer, a tablet computer, a smartphone, or any other type of computing device, for example the computer system 800 of FIG. 8. The computer system 130 can include one or more processors, memory, input devices, and output devices, as described in more detail further hereinafter. Although the control van 110 is described as having the managing process executing on a computer system 130, it is understood that the control van 110 can have 2, 3, 4, or any number of computer systems 130 with 2, 3, 4, or any number of managing process executing on the computer systems 130.

Figure 2:
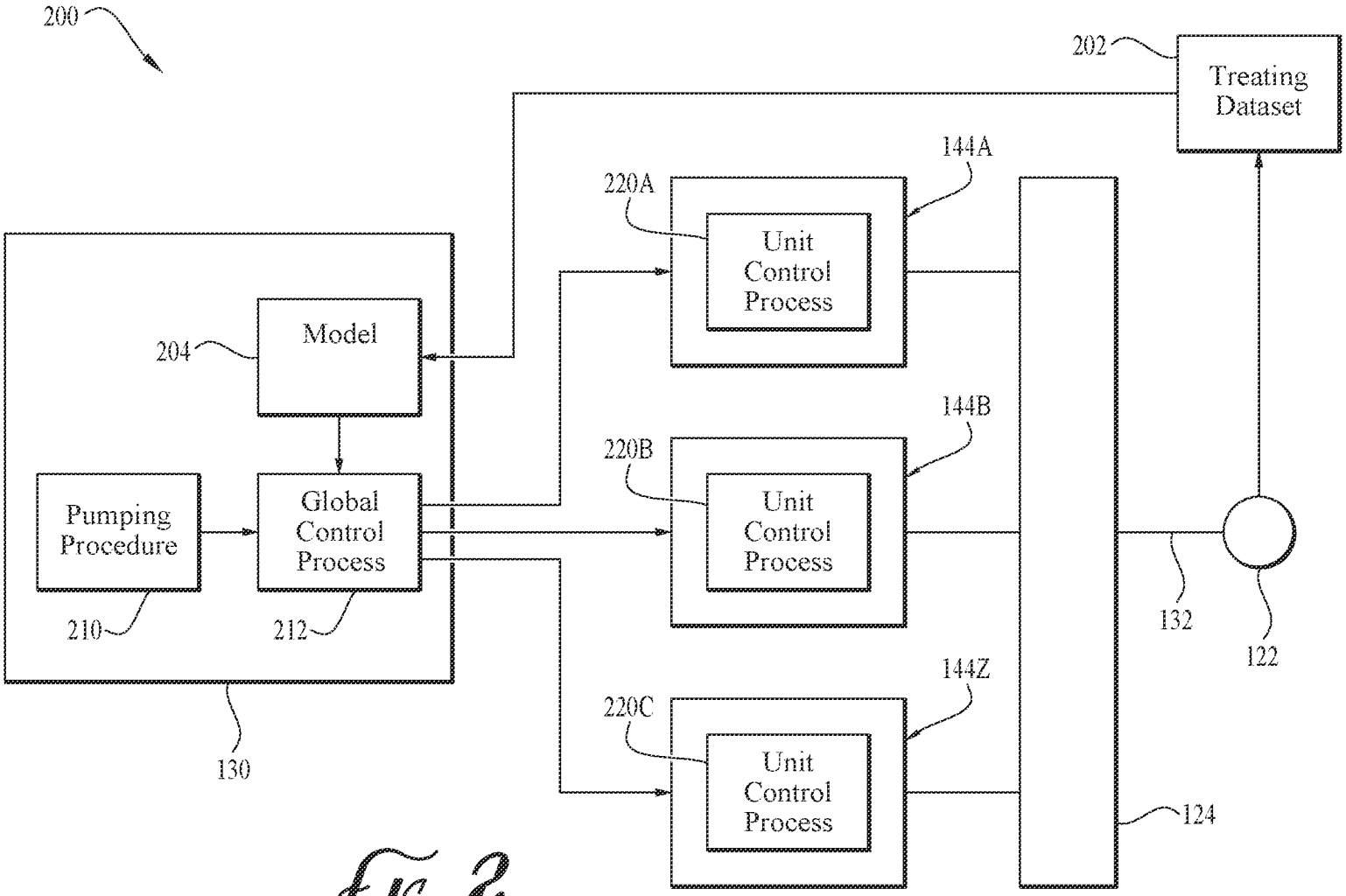
FIG. 2 is block diagram illustrating a global control process coupled to pumping units connected to a treatment well according to an embodiment of the disclosure.

A global control process can direct the fracturing fleet to provide a fracturing fluid at a steady pressure value to a wellbore of a target well. Turning now to FIG. 2, an embodiment of an operating environment 200 for the global control process illustrated. In some embodiments, the global control process 212 can be communicatively connected to the electric frac pumps 144A-Z to direct the pumping operation. As previously described in FIG. 1, the plurality of electric frac pumps 144A-Z can be fluidically connected to a manifold 124 to deliver fracturing fluids to a wellbore within a treatment well 122 via high-pressure line 132. The global control process 212 can be executing on the computer system 130 within the control van 110 illustrated in FIG. 1. The global control process 212 can be communicatively connected to a unit control process 220A-Z executing on a unit controller within each electric frac pump 144A-Z. The unit control process 220 can direct the pumping operation of each electric frac pump 144A-Z as will be described further hereinafter. A treating dataset 202 from sensors coupled with the treatment well 122 can be retrieved by the computer system 130.

The global control process 212 can maintain a constant pressure value during the pumping operation by distributing an operating point to each of the pump units 140. In some embodiments, the global control process 212 can receive an operating point, e.g., a pressure value and a flowrate value, from the pumping procedure 210. The pumping procedure 210, also referred to as a pumping schedule or a pumping sequence, may be comprised of a series of pumping stages with a transition between each pumping stage. For example, a pumping procedure may comprise a plurality of time-dependent or volume dependent pumping intervals, also called pumping stages, executed in a consecutive sequence (e.g., over a time period corresponding to a job timeline). The pumping stages may include steady-state stages and transition stages (e.g., having an increasing or decreasing parameter such as flow rate, proppant concentration, and/or pressure) that may be time dependent or volume dependent. The volume dependent pumping stage may be represented as a function of volume, either the delivered volume or the remaining volume. The time dependent pumping stage may be represented as a function of time. The operating setpoint of a pumping stage delivering fracturing fluids into a target formation can include a target pressure value, a flow rate value, and a proppant concentration value (e.g., density). The target pressure value can be the desired constant pressure value determined to provide the desired fracture propagation within the target formation.

In some embodiments, the pumping procedure 210 can be loaded into the global control process 212. In some embodiments, the pumping procedure 210 can be loaded into a managing process executing on the computer system 130 within the control van 110. In some embodiments, the global control process 212 and the managing process can be combined within a single process or execute separately within the computer system 130.

In some embodiments, the global control process 212 can distribute the operating setpoint received from the pumping procedure 210 to the plurality of electric frac pumps 144A-Z. The global control process 212 can generate a unit setpoint comprising a pressure value, a flowrate value, a density value, or combinations thereof. In some embodiments, the unit setpoint is the operating setpoint. In some embodiments, the unit setpoint is the operating setpoint distributed equally to the electric frac pumps 144A-Z. For example, the global control process 212 can distribute the operating setpoint received from the pumping procedure 210 for a stage designed to deliver a volume of fracturing fluid into a reservoir by dividing the operating setpoint equally and communicating the divided operating setpoint as a unit setpoint to the electric frac pumps 144A-Z. Thus the unit setpoint directs the electric frac pumps 144A-Z to deliver a total treatment pressure and volumetric rate that is equal to the operating setpoint of the pumping procedure 210.

In some embodiments the global control process 212 can retrieve a wellbore pressure value predicted by a modeling application. In some embodiments, the wellbore environment can be modeled with one or more modeling applications. The model can utilize the treating dataset 202 to analyze the current state of the formation and predict a future state of the formation. The model applications can utilize computational fluid dynamics (CFD) modeling, geochemical modeling, rock mechanical modeling, fracture mechanics modeling, or combinations thereof to model the future state of the wellbore environment within the formation due to the delivery of fracturing fluids into the target formation. The model 204 can provide a probability of a change in the wellbore environment, e.g., a future state, to the global control process 212. In some embodiments, the model 204 utilizes the treating dataset 202 and a historical database, a mathematical model, a simulation package, or combinations thereof to predict a future state of the formation to produce a probability value of a change in the wellbore environment, such as a wellbore pressure increase or decrease. For example, the model 204 can provide a probability of a pressure increased based on periodic dataset, e.g., a treating dataset 202, and an historical database comprising recent operational data from prior pumping operations within the same field, e.g., an offset well. The model 204 can communicate the probability of a wellbore pressure change, e.g., a wellbore environment, to the global control process 212.

In some embodiments, the global control process 212 can generate a unit setpoint from the operating setpoint of the pumping procedure, a modeling application, a treating dataset 202, or combinations thereof. The global control process 212 can generate a unit setpoint based on the operating setpoint and a probability value from the model 204. For example, the global control process 212 can generate a unit setpoint that increases the pressure value greater than the operating setpoint, e.g., target pressure value, in response to the probability value from the model 204 for a decrease in wellbore pressure. In another scenario, the global control process 212 can generate a unit setpoint that decreases the pressure value less than the operating setpoint, e.g., target pressure value, in response to the probability value from the model 204 for an increase in wellbore pressure.

In some embodiments, the global control process 212 can generate a unit setpoint from the operating setpoint of the pumping procedure and a treating dataset 202. The global control process 212 can generate a unit setpoint based on the operating setpoint and a decrease in the pressure values within the treating dataset 202. For example, the global control process 212 can generate a unit setpoint that increases the pressure value greater than the operating setpoint, e.g., target pressure value, in response to a decrease in wellbore pressure within the treating dataset 202. In another scenario, the global control process 212 can generate a unit setpoint that decreases the pressure value less than the operating setpoint, e.g., target pressure value, in response to an increase in wellbore pressure within the treating dataset 202.

In some embodiments, the global control process 212 can direct at least one electric frac pumps 144A to increase or decrease the pressure value, flowrate value, or density value, to maintain a steady pressure value due to wellbore environment changes. For example, the global control process 212 can communicate a unit setpoint comprising a value different from the other unit setpoints that increases the flowrate of one of the plurality of electric frac pumps 144 to maintain a target pressure value applied to a wellbore. In another scenario, the global control process 212 can communicate a unit setpoint (different from the unit setpoints sent to the other pumps) that decreases the flowrate of one of the plurality of electric frac pumps 144 to maintain the target pressure applied to a wellbore. In this scenario, the pressure value, flowrate value, and/or density value of the pumping operation delivered by the electric frac pumps 144A-Z may be different than the operating setpoint of the pumping procedure 210 to maintain the target pressure value.

In some embodiments, the global control process 212 can modify a portion, e.g., at least two, simultaneously or sequentially, of the plurality of electric frac pumps 144A-Z to maintain the target pressure. For example, the global control process 212 can communicate a unit setpoint (different from the other unit setpoints) that reduces the flowrate value and/or density value to a second pump unit, then a third pump unit, and so forth to maintain the target pressure. In another scenario, the global control process 212 can communicate a unit setpoint that increases the flowrate value and/or density value to a second pump unit, then a third pump unit, and so forth to maintain the target pressure. The global control process 212 can maintain an optimum target pressure for each setpoint of the pumping operation by sending a unit setpoint comprising a set of unique values to each of the electric frac pumps 144A-Z.

In some embodiments, the treating dataset 202 comprises a periodic dataset indicative of the pumping operation from sensors fluidically coupled to the wellbore. The periodic dataset can comprise a treatment pressure, a treatment flowrate, a density of the treatment fluid, or combinations thereof. The sensors may be coupled to the manifold 124, to the high-pressure line 132, to the production tree, to the wellbore, within the wellbore, or combinations thereof. The treating dataset 202 can be retrieved by the computer system 130 or delivered to the computer system 130.

Figure 3:
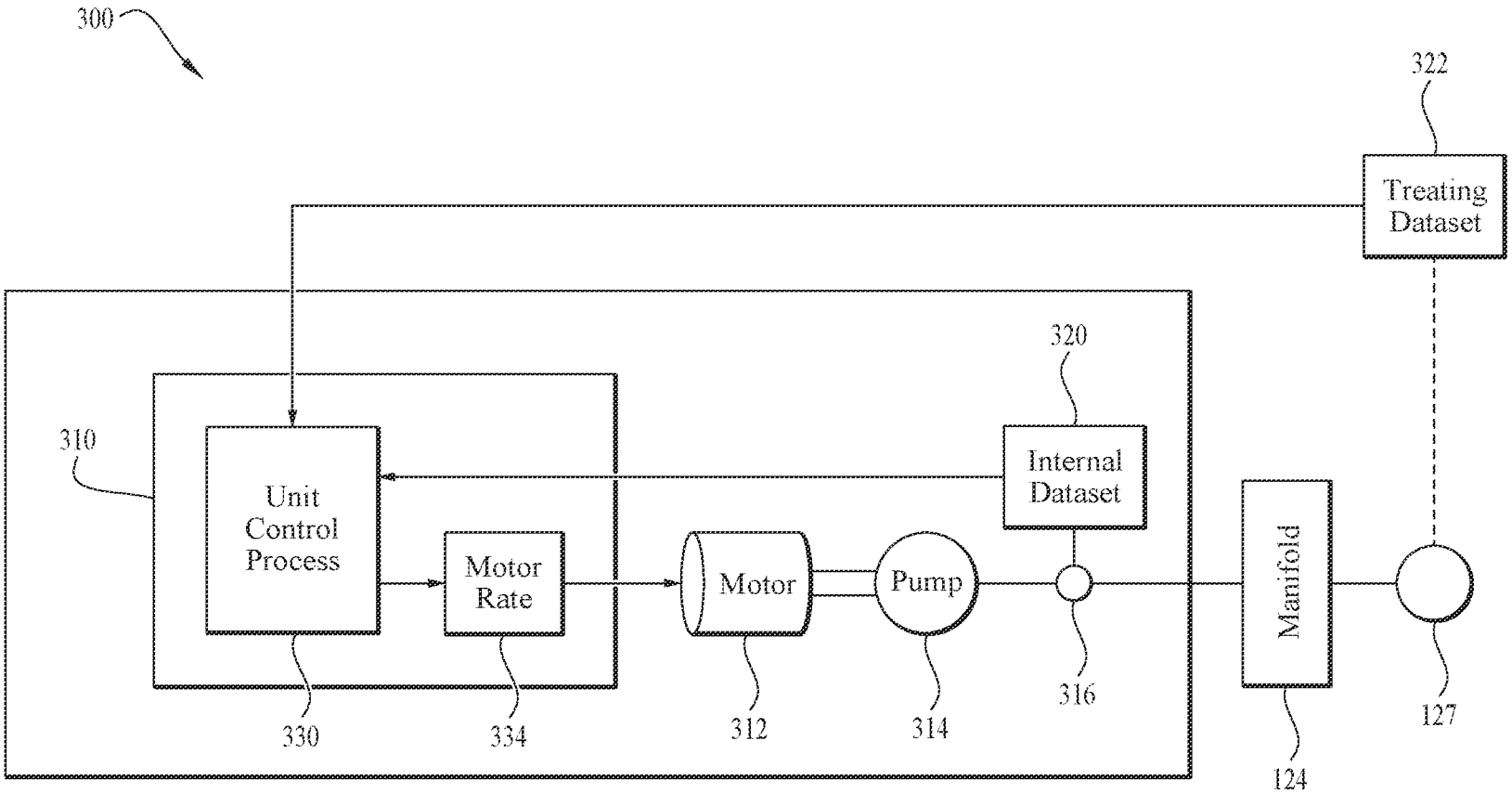
FIG. 3 is block diagram illustrating a pumping unit according to an embodiment of the disclosure.

The method of controlling the hydraulic fracturing pressure to provide a constant target pressure value can include unit level control for each pumping unit. Turning now to FIG. 3, an electric frac pump 300 fluidically connected to the treatment well 122 via the manifold 124 is illustrated. The electric frac pump 300 can be an embodiment of the electric frac pump 144 of FIG. 1. The electric frac pump 300 comprises a unit controller 310, an electric motor 312, a pumping mechanism 314, and a sensor array 316. The pumping mechanism 314 can include a power end, a fluid end, or combinations thereof. The sensor array 316 can provide an internal dataset 320 indicative of the pumping operation. The unit controller 310 can be communicatively connected to the electric motor 312 and sensor array 316. The unit control process 330 executing on the unit controller 310 can receive a unit setpoint 332 from the global control process 212 (as shown in FIG. 2) and communicate a motor rate value 334 to the electric motor 312. The unit control process 330 can be an embodiment of the unit control process 220A-Z illustrated in FIG. 2. In some embodiments, the unit control process 330 can receive a treating dataset 322, e.g., treating dataset 202, and/or an internal dataset 320. The unit control process 330 can request a treating dataset 322 and then request an internal dataset 320 if the treating dataset 322 is not available. For example, the sensor array 316 providing the internal dataset 320 can be operating ten times faster than the sensors providing the treating dataset 322. In this scenario the unit control process 330 can attempt to retrieve a treating dataset 322 and retrieve an internal dataset 320 when the treating dataset 322 is not available. In another scenario, the unit control process may not be able to retrieve both the treating dataset 322 and the internal dataset 320. For example, the quality of the dataset, e.g., sensor measurements, can be low or contain noise and subsequently produce erroneous or out-of-bounds sensor data. The unit control process 330 may ignore the erroneous data, utilize the previous dataset, and request a new dataset. The unit control process 330 can utilize a method to produce a motor rate value 334 from the unit setpoint 332 received from the global control process 212 and either the treating dataset 322 or the internal dataset 320 to produce a motor rate value 334 as will be described hereinafter. The motor rate value 334 can be communicated as a frequency to the electric motor 312 via the variable frequency drive (VFD). The electric motor 312, rotationally coupled to the pumping mechanism 314, can drive the pumping mechanism 314 to produce a desired pressure value and flowrate value of the treating fluid.

Figure 4:
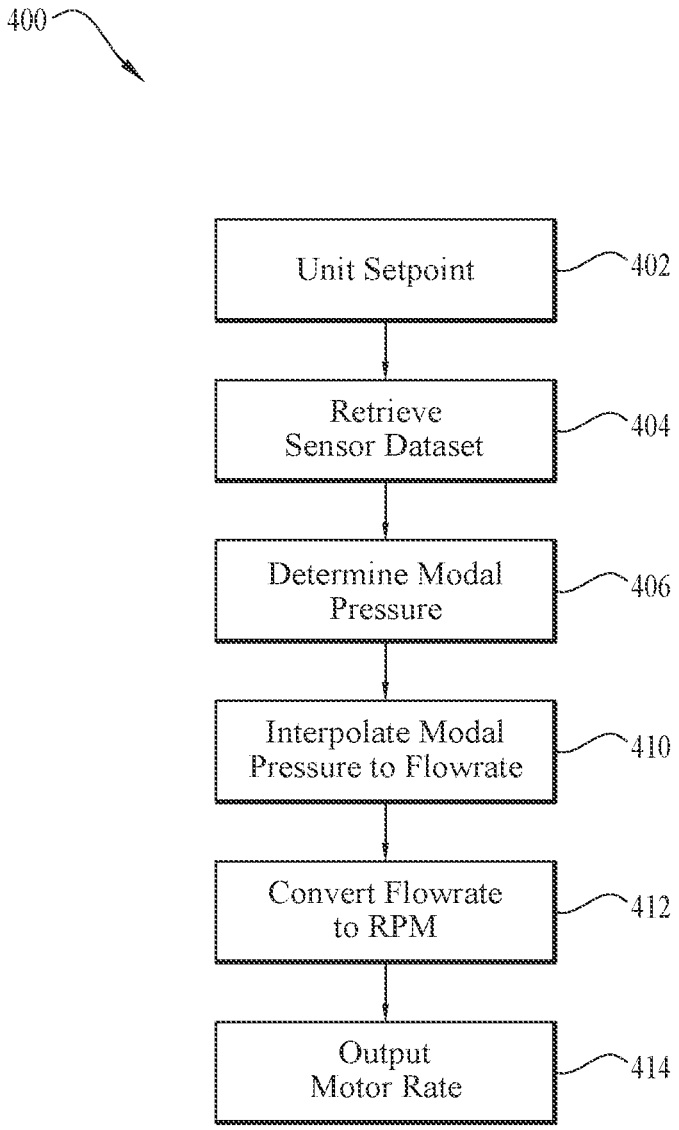
FIG. 4 is a logical block diagram depicting a method of pumping a fracturing treatment at a target pressure according to an embodiment of the disclosure.
Figure 5:
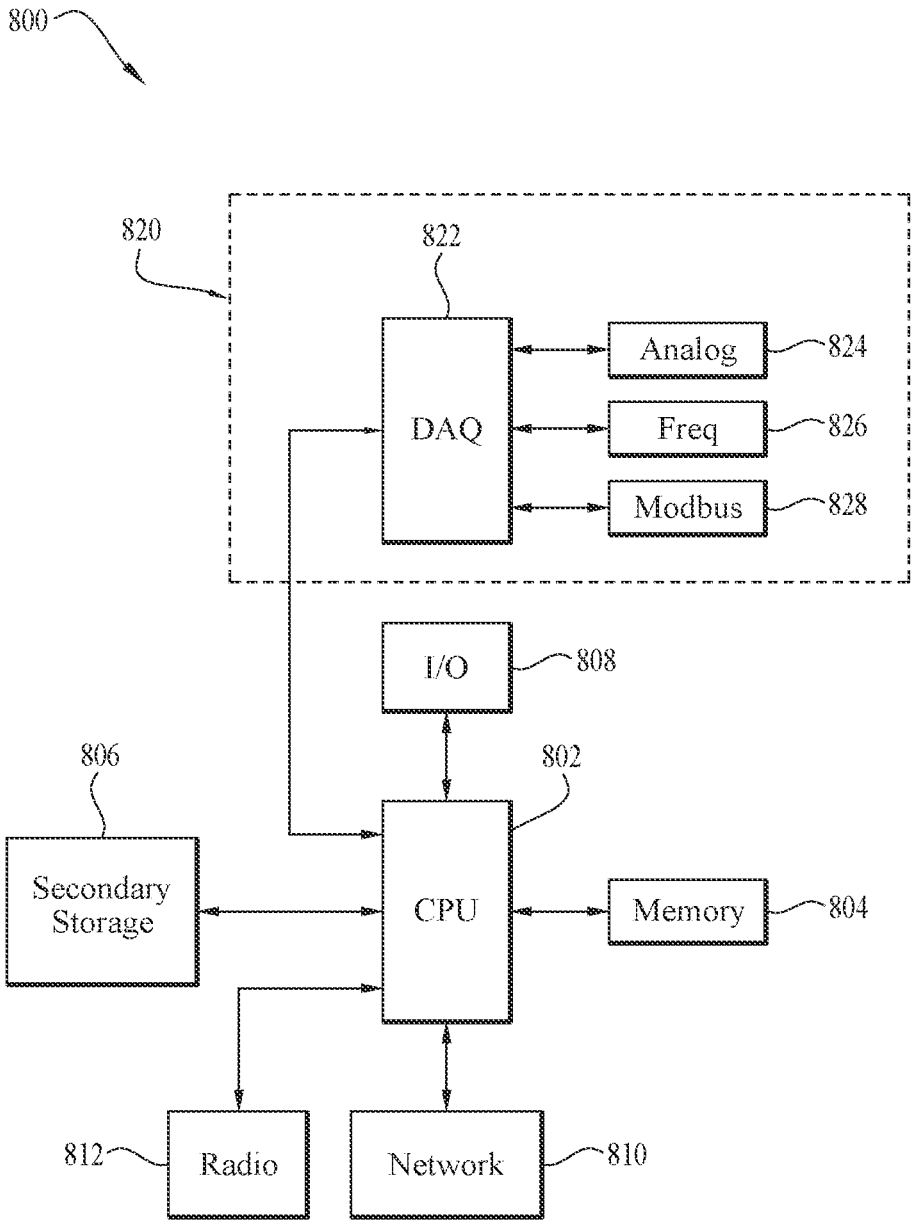
FIG. 5 is a block diagram of a computer system according to an embodiment of the disclosure.

The unit control process 330 can utilize a method to control the pumping operation of the electric frac pump 300. Turning now to FIG. 4, a method 400 for providing a constant pressure while delivering fracturing fluids to a formation is illustrated with a logic flow diagram. In some embodiments, the method 400 comprises receiving a unit setpoint, e.g., unit setpoint 332, from a process executing on the computer system 130 within the control van 110. The method 400 can compare the unit setpoint to a periodic dataset, e.g., treating dataset 322. The method 400 can determine a modal pressure from the comparison of the unit setpoint to the periodic dataset. The method 400 can interpolate the modal pressure to a modal setpoint comprising a pressure value, a flowrate value, a density value, or combinations thereof. The method 400 can convert the modal setpoint to a motor rate value 334 of the electric motor, e.g., electric motor 312. The method can communicate the motor rate value 334 to the electric motor.

At step 402, the method 400 comprises receiving a unit setpoint, e.g., the unit setpoint 332. In some embodiments, the unit control process 330 can receive a unit setpoint from the global control process 212.

At step 404, the method 400 comprises retrieving a periodic dataset, e.g., treating dataset 322, from sensors measuring the pumping operation. In some embodiments, the unit control process 330 retrieves a periodic dataset comprising a treating dataset 322, an internal dataset 320, the motor torque value, or combinations thereof. The unit control process 330 can attempt retrieval of the treating dataset 322. The unit control process 330 can attempt retrieval of the internal dataset 320 when the treating dataset 322 is not available. The unit control process 330 can retrieve a motor torque value from the VFD when the internal dataset 320 is not available. The unit control process 330 can convert the motor torque value to a pressure value by interpolating an equation describing the motor torque value to the pump pressure value for the electric frac pump 144.

At step 406, the method 400 comprises determining a modal pressure value from the comparison of the unit setpoint 332 to the periodic dataset. In some embodiments, the method 400 determines the modal pressure value from the difference between the unit setpoint 332 and the periodic dataset. For example, the modal pressure value may be greater than the unit setpoint 332 when the periodic dataset is less than the unit setpoint 332. In another example, the modal pressure value may be less than the unit setpoint 332 when the periodic dataset is greater than the unit setpoint 332. In some embodiments, the method 400 may determine the modal pressure value from a predictive pressure provided by a model, e.g., model 204.

At step 410, the method 400 comprises interpolating the modal pressure value to a modal setpoint comprising a pressure value, a flowrate value, a density value, or combinations thereof. The unit control process 330 can determine the modal setpoint by interpolating the modal pressure value from a pump performance curve. The pump performance curve comprises the fluid end response to the power end and thus, can be unique for each combination of power end and fluid end. For example, an electric motor coupled with a high torque transmission and fluid end with large, e.g., 4.5 inch, plungers can have a different response, e.g., a performance curve, in comparison to an electric motor coupled with a high speed transmission and a fluid end with medium, e.g., 4 inch, plungers. The modal pressure value can be modified by a pressure or flowrate dataset from the internal dataset 320 so that the pump discharge pressure matches the modal pressure value.

At step 412, the method 400 comprises converting the modal setpoint to a motor rate value 334 of the electric motor, e.g., electric motor 312. The motor rate value 334 may be a RPM value.

At step 414, the method 400 comprises outputting the motor rate value 334 to the electric motor. In some embodiments, the unit control process 330 can communicate the motor rate value 334 to the electric motor, e.g., electric motor 312 of FIG. 3.

As previously described in FIG. 3, the electric motor 312 can be rotationally coupled to the pumping mechanism 314. The motor rate value 334 from method 400 can direct the electric motor 312, via the VFD, to provide the pumping mechanism 314 the torque and rotational motion to produce a desired pressure value and flowrate value, e.g., modal setpoint, of the treating fluid. The modal setpoint can be equal to the unit setpoint 332 when the periodic dataset is constant in response to the downhole environment not changing. The pressure, flowrate, and density of the fracturing fluid output from the pumping mechanism 314 may be less than the unit setpoint 332 in response to the modal setpoint being less than the unit setpoint 332 in response to the periodic dataset indicating a change to the downhole environment. For example, the periodic dataset may indicate an increase in pressure within the wellbore. The method 400 may set the modal setpoints less than the unit setpoint 332, e.g., the desired constant pressure, to compensate for the increase in pressure within the wellbore. The unit control process 330 can maintain an constant pressure for each setpoint of the pumping operation based on periodic datasets of sensor data from the wellhead and/or sensor data from the pumping unit.

The hydraulic fracturing operation comprises designing a wellbore treatment, transporting the wellbore treatment blend to a wellsite, and pumping a wellbore treatment fluid into a porous formation. The wellbore treatment design can include the design of the treatment blend, assignment of the pumping equipment, and a pumping procedure. The design of the treatment blend can comprise wet or dry treatment materials that can be combined with a liquid, e.g., water, for pumping into the wellbore. In some embodiments, the treatment blend can generate a gelled water, a slick-water, or a cementitious material when mixed with water, acid, or other mixing liquid. In some embodiments, the wellbore treatment includes proppant, e.g., sand. The design of the wellbore treatment can include the assignment of pumping equipment to a fracturing fleet. For example, a plurality of pump units 140 can be assigned to a fracturing fleet for the pumping operation. The design of the wellbore treatment can include a pumping procedure, also referred to as a pumping schedule. The pumping procedure can include a multiple time based intervals or volume based intervals for the placement of the wellbore treatment into a target zone within the wellbore of the treatment well. In some embodiments, the target zone is at least one formation beginning and ending at a measured distance from the surface. In some embodiments, the target zone is a subterranean porous formation located at a measured distance from the surface. In some embodiments, the wellbore procedure can be designed to induce fractures within a target zone in response to the applied hydraulic pressure, the treatment blend can be designed to transport proppant into the porous formation via the induced fractures, and a volume of proppant retained within the formation can be designed to hold open the induced fractures.

In some embodiments, a volume of wellbore treatment materials, e.g., treatment blend and/or proppant, can be transported to a remote wellbore site with the fracturing fleet. The fracturing fleet can comprise a plurality of pumping units 140 with at least one electric frac pump 144. In some embodiments, the fracturing fleet can comprise a plurality of pumping units with an electric group or set of electric frac pumps 144A-Z. The fracturing fleet can be assembled at the remote wellsite. The plurality of pumping units 140 can be fluidically connected to the wellbore of the treatment well 122 via a manifold 124 and a high-pressure line 132.

In some embodiments, a managing application executing on a computer system 130 within a control van 110 can be communicatively connected to the frac units of the fracturing fleet. The term frac units can refer to the plurality of pump units, one or more manifolds, a blending unit a hydration blender, a proppant storage unit, a chemical unit a water supply unit, a control van, or combinations thereof. The computer system 130 can receive a plurality of periodic datasets from sensors within each frac unit indicative of the pumping operation. In some embodiments, the computer system 130 can retrieve a plurality of periodic datasets of the wellbore environment from sensors attached to the wellbore or located within the wellbore. In some embodiments, the computer system 130 can retrieve a plurality of periodic datasets from sensors fluidically connected to the wellbore, such as the manifold 124, the high-pressure line 132, the production tree, or combinations thereof. In some embodiments, the managing application can direct the pumping operation per the pumping procedure to mix a treatment blend and pump a treatment blend into the wellbore of the treatment well 122.

In some embodiments, a global control process executing on the computer system 130 can direct the pumping operation to deliver the fracturing fluid at a target pressure, e.g., a steady pressure value, to the target formation. The global control process 212 can be a part of the managing application, a stand-alone process, or combinations thereof. The global control process 212 can monitor the sensor measurements (e.g., the fluid output) of each pump unit 140, compare the measurements to a target pressure, and modify the fluid output to achieve the target pressure during the pumping operation. In some embodiments, a method for delivering a target pressure of the pumping operation comprises receiving an operating setpoint from the pumping procedure. The method comprises determining an unit setpoint for each of the electric frac pumps 144. In some embodiments, the unit setpoint is the operating setpoint. In some embodiments, the method comprises generating a unit setpoint based on the operating setpoint and a model 204 providing a probability of a change in the wellbore pressure. For example, the method can generate a unit setpoint lower than the operating setpoint based on the probability of the wellbore pressure increasing. In some embodiments, the method comprises generating a unit setpoint based on the operation setpoint and a periodic dataset indicative of the wellbore environment. For example, the method can generate a unit setpoint higher than the operating setpoint in response to decreasing pressure values within the treating dataset 202. In some embodiments, the global control process 212 can direct at least one electric frac pump 144A to increase or decrease the pressure value, flowrate value, or density value to maintain the target pressure value due to wellbore pressure changes. For example, the global control process 212 can communicate a unit setpoint comprising unique values to a first electric frac pump 144A compared to the unit setpoint communicated to the remaining electric frac pumps 144B-Z that increases the flowrate of the first electric frac pumps 144A to maintain a target pressure value applied to a wellbore. In some embodiments, the global control process 212 can communicate the unit setpoint to a unit control process 220A-Z on each electric pumping unit 144A-Z.

In some embodiments, a unit control process 330 executing on a unit controller 310 on each of the electric frac pumps 144 can direct the pumping operation to deliver a target pressure, e.g., a constant fracturing pressure, during a fracturing operation. In some embodiments, the electric frac pump 300 comprises a unit controller 310, an electric motor 312, a pumping mechanism 314, and a sensor array 316. The unit control process 330 on the unit controller 310 can receive a unit setpoint 332 and communicate a motor rate value 334 to the electric motor 312. A method 400 for providing a constant pressure, e.g., a target pressure, while delivering fracturing fluids to a formation comprises receiving a unit setpoint, comparing the unit setpoint to a periodic dataset, determining a modal pressure from the comparison, interpolating the modal pressure to a modal setpoint comprising a pressure value, a flowrate value, a density value, or combinations thereof, the modal setpoint to a motor rate value 334 of the electric motor, and communicating the motor rate value 334 to the electric motor.

Turning now to FIG. 8, the computer system 130 and the unit controller 310 for the fracturing units may be a computer system 800 with a processor 802, memory 804, secondary storage 806, and input-output devices 808. The computer system 130 may establish a wireless link with a mobile carrier network (e.g., 5G core network) and/or satellite with a long range radio transceiver 812 to receive data, communications, and, in some cases, voice and/or video communications. The input-output devices 808 of the computer system 130 may also include a display, an input device (e.g., touchscreen display, keyboard, etc.), a camera (e.g., video, photograph, etc.), a speaker for audio, or a microphone for audio input by a user. A network device 810 may include a short range radio transceiver to establish wireless communication with Bluetooth, Wi-Fi, or other low power wireless signals such as ZigBee, Z-Wave, 6LoWPan, Thread, and Wi-Fi-ah. The long range radio transceiver 812 may be able to establish wireless communication with an access node for the mobile carrier network based on a 5G, LTE, CDMA, or GSM telecommunications protocol. The computer system 130 may be able to support two or more different wireless telecommunication protocols and, accordingly, may be referred to in some contexts as a multi-protocol device. The computer system 130 may communicate with another computer system via the wireless link provided by the access node of the mobile carrier network (or satellite) and via wired links provided by 5G core network and a private network, a public network, or combinations thereof. Although computer system 130 is illustrated as a single device, the computer system 130 may be a system of devices. The unit controller for the fracturing units, e.g., pump units 140, may include additional components and functionality such as secondary storage 806 and input-output module 820 as will be disclosed hereinafter.

The access node may also be referred to as a cellular site, cell tower, cell site, or, with 5G technology, a gigabit Node B. The access node provides wireless communication links to the communication device, e.g., radio 812 on the computer system 130 and unit controller, according to a 5G, a long term evolution (LTE), a code division multiple access (COMA), or a global system for mobile communications (GSM) wireless telecommunication protocol.

The satellite may be part of a network or system of satellites that form a network. The satellite may communicatively connect to the communication device (e.g., radio 812) of the computer system 130, the communication device of the unit controller, the access node, the mobile carrier network, the private/public network, or combinations thereof. The satellite may communicatively connect to the public/private network independent of the access node of the mobile carrier network.

The communication device may establish a wireless link with the mobile carrier network (e.g., 5G core network) with a long-range radio transceiver, e.g., 812 of FIG. 3, to receive data, communications, and, in some cases, voice and/or video communications. The communication device may also include a display and an input device, a camera (e.g., video, photograph, etc.), a speaker for audio, or a microphone for audio input by a user. The long range radio transceiver 812 of the communication device may be able to establish wireless communication with the access node based on a 5G, LTE, COMA, or GSM telecommunications protocol and/or satellite. The communication device may be able to support two or more different wireless telecommunication protocols and, accordingly, may be referred to in some contexts as a multi-protocol device. The communication device, e.g., radio 812 on a unit controller, may communicate with another communication device, e.g., radio 812 on a unit controller, on a second pump unit via the wireless link and via wired links provided by the mobile carrier network. For example, a pump unit 140A may communicate with pump units 140B, 140C, 140D, 140E, and 140F at the same wellsite or at multiple wellsites. In an embodiment, the pump units 140A-F may be a different types of pump units at the same wellsite or at multiple wellsites. For example, the pump unit 140A may be a frac pump, pump unit 140B may be a blender, pump unit 140C may be water supply unit, pump unit 140D may be a cementing unit, and pump unit 140E may be a mud pump. The pump unit 140A-F may be communicatively coupled together at the same wellsite by one or more communication methods. The pump units 140A-F may be communicatively couple with a combination of wired and wireless communication methods. For example, a first group of pump units 140A-C may be communicatively coupled with wired communication, e.g., Ethernet. A second group of pump units 140D-E may be communicatively couple to the first group of pump units 140A-C with low powered wireless communication, e.g., WI-FI. A third group of pump units 140F may be communicatively coupled to one or more of the first group or second group of pump units by a long range radio communication method, e.g., mobile carrier network.

The computer system 800 may comprise an input-output module 820, e.g., DAQ card, for communication with one or more sensors. The module 820 may be a standalone system with a processor 822, memory, and one or more applications executing in memory. The module 820, as illustrated, may be a card or a device within the computer system 800. In some embodiments, the module 820 may be combined with the input-output device 808. The module 820 may receive one or more analog inputs 824, one or more frequency inputs 826, and one or more Modbus inputs 828. For example, the analog input 824 may include a volume sensor, e.g., a tank level sensor. For example, the frequency input 826 may include a flow mete i.e., a fluid system flowrate sensor. For example, the Modbus input 828 may include a pressure transducer. The processor 822 may convert the signals received via the analog input 824, the frequency input 826, and the Modbus input 828 into the corresponding sensor data. For example, the processor 822 may convert a frequency input 826 from the flowrate sensor into flow rate data measured in gallons per minute (GPM).

ADDITIONAL DISCLOSURE

The following are non-limiting, specific embodiments in accordance with the present disclosure:

A first embodiment, which is a method of modifying a pumping stage of a pumping operation of a fracturing fleet at a wellsite, comprising: receiving, by a global control process executing on a computer system, an operating setpoint for a stage of a pumping schedule, wherein the pumping schedule comprises a plurality of stages, and wherein the operating setpoint comprises a target pressure; communicating, by the global control process, a first unit setpoint to each of a plurality of pump units, wherein the first unit setpoint comprises the target pressure; pumping, by the plurality of pump units, a fracturing fluid at a target pressure into a target formation in response to receiving the first unit setpoint; determining, by the global control process, a second unit setpoint in response to a wellbore pressure change; communicating, by the global control process, the second unit setpoint to at least one of the plurality of pump units; and pumping, by the plurality of pump units, the fracturing fluids at the target pressure into the target formation in response to at least one pump unit pumping the fracturing fluids at a second setpoint and a remaining portion of the pump units pumping the fracturing fluids at the first unit setpoint, and wherein the second unit setpoint comprises a pressure value greater than or less than the target pressure.

A second embodiment, which is the method of the first embodiment, further comprising: receiving, by a unit control process executing on a unit controller of each of the pump units, the first unit setpoint; determining, by the unit control process, a modal pressure by comparing the unit setpoint to a periodic dataset; interpolating, by the unit control process, the modal pressure to a modal setpoint comprising a pressure value, a flowrate value, a density value, or combinations thereof; wherein the modal setpoint to a motor rate value; communicating, by the unit control process, the motor rate value to an electric motor; and pumping the fracturing fluids per the modal setpoint.

A third embodiment, which is the method of the first and second embodiment, wherein the periodic dataset comprises measurements from i) an internal sensor array or ii) sensors fluidically connected to a wellbore.

A fourth embodiment, which is the method of the second embodiment, wherein the pump unit is an electric frac pump comprising an electric motor coupled to a pumping mechanism.

A fifth embodiment, which is the method of the fourth embodiment, wherein the pumping mechanism comprises a plunger pump, a piston pump, a centrifugal pump, a multistage centrifugal pump, a turbine pump, an auger pump, or combinations thereof.

A sixth embodiment, which is the method of the first and second embodiment, wherein: the wellbore pressure change is determined by a periodic dataset a probability of a wellbore pressure change, or combinations thereof.

A seventh embodiment, which is the method of the sixth embodiment, wherein: the periodic dataset is indicative of the pumping operation from sensors i) fluidically connected to the wellbore, ii) coupled to the wellbore, iii) located within the wellbore, or iv) combinations thereof; and wherein the probability of a wellbore pressure change is determined by a model.

An eighth embodiment, which is the method of the first through the seventh embodiment, wherein the model determines a probability of a wellbore pressure change based on a periodic dataset, a mathematical model, a historical dataset, or combinations thereof.

A ninth embodiment, which is the method of the first embodiment, wherein the stage comprises a volume of fluid of the pumping schedule or a time property of the pumping schedule.

A tenth embodiment, which is the method of the first and second embodiment, further comprising; transporting a wellbore treatment design and a fracturing fleet to a wellsite, wherein the wellbore treatment design comprises wellbore treatment blend, a volume of proppant, a pumping procedure, or combinations thereof; assembling the fracturing fleet at the wellsite, wherein the plurality of pump units are fluidically connected to the wellbore of the treatment well; mixing the wellbore treatment per the pumping procedure; and operating the pump units of the fracturing fleet to place the wellbore treatment into the wellbore per the pumping procedure.

An eleventh embodiment, which is the method of the first and second embodiment, wherein: the fracturing fleet comprises a plurality of pump units, a manifold, a blending unit, a hydration blender a proppant storage unit, a chemical unit, a water supply unit, or combinations thereof.

A twelfth embodiment, which is a method of controlling a pumping sequence of a fracturing fleet at a wellsite, comprising: receiving, by a global control process executing on a computer system, an operating setpoint for a stage of a pumping procedure, wherein the operating setpoint comprises a target pressure; directing, by the global control process, a pumping operation of a plurality of pump units comprising at least two electric frac pumps 144 by transmitting a first unit setpoint to each of the pump units 140 wherein the first unit setpoint is the operating setpoint, and wherein the plurality of pump units are communicatively connected to the computer system; determining a wellbore pressure change; and maintaining, by the global control process, the target pressure of the pumping operating by communicating a second unit setpoint to at least one electric frac pump 144 in response to the wellbore pressure change.

A thirteenth embodiment, which is the method of the twelfth embodiment, wherein: the second unit setpoint increases a pressure output of the at least one electric frac pump 144 in response to a decrease in a wellbore pressure value; and wherein the second unit setpoint decreases the pressure output of the at least one electric frac pump 144 in response to an increase in the wellbore pressure value.

A fourteenth embodiment, which is the method of the twelfth and thirteenth embodiment, wherein: the wellbore pressure change is determined by a periodic dataset, a probability of a wellbore pressure change, or combinations thereof; wherein the periodic dataset is indicative of the pumping operation from sensors i) fluidically connected to the wellbore, ii) coupled to the wellbore, iii) located within the wellbore, or iv) combinations thereof; wherein the probability of a wellbore pressure change is determined by a model.

A fifteenth embodiment, which is a fracturing fleet system at a wellsite, comprising: a blender fluidically connected to a manifold; a plurality of pumping units comprising at least two electric frac pumps fluidically connected to the manifold; a wellbore fluidically connected to the manifold; an global control process, executing on a computer system, controlling a pumping operation of the fracturing fleet; wherein the global control process is configured to perform the following: loading an operating setpoint for an interval of a pumping procedure, wherein the operating setpoint comprises a target pressure value; determining a first unit setpoint and a second unit setpoint, wherein the first unit setpoint is equal to the target pressure value, wherein the second unit setpoint is i) equal to, ii) less than, or iii) greater than the first unit setpoint in response to a probability value or a treating dataset indicating that a wellbore pressure is i) equal to, ii) greater than, or iii) less than the target pressure; and communicating the second unit setpoint to a first electric frac unit and a first unit setpoint to the remaining electric frac units; and pumping a fracturing treatment into the wellbore at the target pressure in response to the first electric frac unit delivering the fracturing treatment at a pressure value i) equal to the target pressure, ii) less than the target pressure, or iii) greater than the target pressure.

A sixteenth embodiment, which is the fracturing fleet system of the fifteenth embodiment, further comprising a proppant storage unit fluidically connected to the blender.

A seventeenth embodiment, which is the fracturing fleet system of the fifteenth embodiment, wherein: the blender is configured to deliver a treatment fluid to the manifold; and the wellbore receives a treatment fluid per the operating setpoint for the interval of the pumping procedure comprising the treatment fluid from the manifold.

An eighteenth embodiment, which is the fracturing fleet system of the fifteenth embodiment, wherein: the treating dataset is a periodic dataset from sensors i) fluidically connected to the wellbore, ii) coupled to the wellbore, iii) located within the wellbore, or iv) combinations thereof; and wherein the probability value is a probability of an increase or decrease in a wellbore pressure as determined by a model.

A nineteenth embodiment, which is the fracturing fleet system of the fifteenth embodiment, wherein the global control process is communicatively connected to a unit controller within each fracturing unit of the fracturing fleet, and wherein the unit controllers are configured to control the frac units.

A twentieth embodiment, which is the fracturing fleet system of the nineteenth embodiment, wherein the fracturing unit comprises a fracturing pump, a manifold, a blending unit, a hydration blender, a proppant storage unit, a chemical unit, or a water supply unit, While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A method of modifying a pumping stage of a pumping operation of a fracturing fleet at a wellsite, comprising:

providing a wellbore treatment design and a fracturing fleet at a wellsite, wherein the wellbore treatment design comprises a wellbore treatment blend, a volume of proppant, a designed pumping procedure, or combinations thereof;

receiving, by a global control process executing on a computer system, an operating setpoint for a current stage of the designed pumping procedure, wherein the designed pumping procedure comprises a plurality of sequential stages, and wherein the operating setpoint comprises a target pressure;

communicating, by the global control process, a first unit setpoint to each of a plurality of pump units, wherein the first unit setpoint comprises the target pressure;

pumping, the current stage by the plurality of pump units, a fracturing fluid at a target pressure into a target formation in response to receiving the first unit setpoint;

determining, by the global control process, a second unit setpoint in response to a wellbore pressure change during the current stage;

communicating, by the global control process, the second unit setpoint to at least one of the plurality of pump units; and pumping, the current stage by the plurality of pump units, the fracturing fluids at the target pressure into the target formation in response to at least one pump unit pumping the fracturing fluids at the second unit setpoint and a remaining portion of the pump units pumping the fracturing fluids at the first unit setpoint, and wherein the second unit setpoint comprises a pressure value greater than or less than the target pressure.

2. The method of claim 1, further comprising:

receiving, by a unit control process executing on a unit controller of each of the pump units, the first unit setpoint;

determining, by the unit control process, a modal pressure by comparing the unit setpoint to a periodic dataset;

interpolating, by the unit control process, the modal pressure to a modal setpoint comprising a pressure value, a flowrate value, a density value, or combinations thereof; wherein the modal setpoint to a motor rate value;

communicating, by the unit control process, the motor rate value to an electric motor; and pumping the fracturing fluids per the modal setpoint.

3. The method of claim 2, wherein the periodic dataset comprises measurements from i) an internal sensor array or ii) sensors fluidically connected to a wellbore.

4. The method of claim 2, wherein the pump unit is an electric frac pump comprising an electric motor coupled to a pumping mechanism.

5. The method of claim 4, wherein the pumping mechanism comprises a plunger pump, a piston pump, a centrifugal pump, a multi-stage centrifugal pump, a turbine pump, an auger pump, or combinations thereof.

6. The method of claim 1, wherein:

the wellbore pressure change is determined by a periodic dataset, a probability of a wellbore pressure change, or combinations thereof.

7. The method of claim 6, wherein:

the periodic dataset is indicative of the pumping operation from sensors i) fluidically connected to the wellbore, ii) coupled to the wellbore, iii) located within the wellbore, or iv) combinations thereof; and wherein the probability of a wellbore pressure change is determined by a model.

8. The method of claim 7, wherein the model determines a probability of a wellbore pressure change based on a periodic dataset, a mathematical model, a historical dataset, or combinations thereof.

9. The method of claim 1, wherein the current stage comprises a volume of fluid of the pumping procedure or a time property of the pumping procedure.

10. The method of claim 1, further comprising;

assembling the fracturing fleet at the wellsite, wherein the plurality of pump units are fluidically connected to the wellbore of the treatment well;

mixing the wellbore treatment per the pumping procedure; and operating the pump units of the fracturing fleet to place the wellbore treatment into the wellbore per the pumping procedure.

11. The method of claim 1, wherein:

the fracturing fleet comprises a plurality of pump units, a manifold, a blending unit, a hydration blender, a proppant storage unit, a chemical unit, a water supply unit, or combinations thereof.

12. The method of claim 1, further comprising:

iterating, by the global control process, from the current stage to a successive stage of the designed pumping procedure in response to completing the current stage, wherein the successive stage becomes the current stage in response to the iteration.

13. A method of controlling a pumping sequence of a fracturing fleet at a wellsite, comprising:

receiving, by a global control process executing on a computer system, an operating setpoint for a current stage of a designed pumping procedure, wherein the operating setpoint comprises a target pressure, and wherein the designed pumping procedure comprises a plurality of sequential pumping stages;

directing, by the global control process, a pumping operation of a plurality of pump units comprising at least two electric frac pumps by transmitting a first unit setpoint to each of the pump units, wherein the first unit setpoint is the operating setpoint, and wherein the plurality of pump units are communicatively connected to the computer system;

determining a wellbore pressure change; and maintaining, by the global control process, the target pressure of the pumping operating by communicating a second unit setpoint to at least one electric frac pump in response to the wellbore pressure change.

14. The method of claim 13, wherein:

the second unit setpoint increases a pressure output of the at least one electric frac pump in response to a decrease in a wellbore pressure value; and wherein the second unit setpoint decreases the pressure output of the at least one electric frac pump in response to an increase in the wellbore pressure value.

15. The method of claim 13, wherein:

the wellbore pressure change is determined by a periodic dataset, a probability of a wellbore pressure change, or combinations thereof;

wherein the periodic dataset is indicative of the pumping operation from sensors i) fluidically connected to the wellbore, ii) coupled to the wellbore, iii) located within the wellbore, or iv) combinations thereof;

wherein the probability of a wellbore pressure change is determined by a model.

16. A fracturing fleet system at a wellsite, comprising:

a blender fluidically connected to a manifold;

a plurality of pumping units comprising at least two electric frac pumps fluidically connected to the manifold;

a wellhead connector fluidically connected to the manifold;

an global control process, executing on a computer system, controlling a pumping operation of the fracturing fleet;

wherein the global control process is configured to perform the following:

loading an operating setpoint for an interval of a designed pumping procedure, wherein the operating setpoint comprises a target pressure value, and wherein the designed pumping procedure comprises a plurality of sequential pumping stages;

determining a first unit setpoint and a second unit setpoint, wherein the first unit setpoint is equal to the target pressure value, wherein the second unit setpoint is i) equal to, ii) less than, or iii) greater than the first unit setpoint in response to a probability value indicating that a wellbore pressure is i) equal to, ii) greater than, or iii) less than the target pressure; and communicating the second unit setpoint to a first electric frac unit and a first unit setpoint to the remaining electric frac units; and pumping a fracturing treatment into the wellhead connector at the target pressure in response to the first electric frac unit delivering the fracturing treatment at a pressure value i) equal to the target pressure, ii) less than the target pressure, or iii) greater than the target pressure.

17. The fracturing fleet system of claim 16, further comprising a proppant storage unit fluidically connected to the blender.

18. The fracturing fleet system of claim 16, wherein:

the blender is configured to deliver a treatment fluid to the manifold; and the wellhead connector receives a treatment fluid per the operating setpoint for the interval of the pumping procedure comprising the treatment fluid from the manifold.

19. The fracturing fleet system of claim 16, wherein:

wherein the probability value is a probability of an increase or decrease in a wellbore pressure as determined by a model.

20. The fracturing fleet system of claim 16, wherein the global control process is communicatively connected to a unit controller within each frac unit of the fracturing fleet, and wherein the unit controller within each frac unit are configured to control the frac units.

21. The fracturing fleet system of claim 20, wherein the frac unit comprises a fracturing pump, a manifold, a blending unit, a hydration blender, a proppant storage unit, a chemical unit, or a water supply unit.

* * * * *